US007575383B2

(12) United States Patent
Kitamura et al.

(10) Patent No.: US 7,575,383 B2
(45) Date of Patent: Aug. 18, 2009

(54) RECORDING APPARATUS

(75) Inventors: Gen Kitamura, Kawasaki (JP); Hitoshi Nishitani, Ohta-ku (JP); Kenji Ito, Yokohama (JP); Hideki Kawashima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 352 days.

(21) Appl. No.: 11/561,781

(22) Filed: Nov. 20, 2006

(65) Prior Publication Data

US 2007/0122221 A1 May 31, 2007

(30) Foreign Application Priority Data

Nov. 25, 2005 (JP) ..... 2005-340166

(51) Int. Cl.

| | |
|---|---|
| ***B41J 35/28*** | (2006.01) |
| ***B41J 13/00*** | (2006.01) |
| ***B41J 13/16*** | (2006.01) |
| ***B41J 11/58*** | (2006.01) |

(52) U.S. Cl. ..... 400/208; 400/624; 400/625; 400/628; 400/629

(58) Field of Classification Search ..... 400/624, 400/625, 628, 629, 120.01, 88; 347/214, 347/215, 216, 222

See application file for complete search history.

(56) References Cited

U.S. PATENT DOCUMENTS 4,914,452 A 4/1990 Fukawa

FOREIGN PATENT DOCUMENTS

| | | |
|---|---|---|
| EP | 0891871 | 1/1999 |
| JP | 2000-108442 | 4/2000 |

*Primary Examiner*—Scott B. Geyer
*Assistant Examiner*—Desmond Mathews
(74) *Attorney, Agent, or Firm*—Canon USA, Inc. IP Div.

(57) ABSTRACT

The present invention easily provides a compact recording apparatus including a paper chamber capable of containing paper and a ribbon chamber containing an ink ribbon in a manner such that the ink ribbon on a supply shaft can be taken up onto a take-up shaft, by utilizing the dead spaces in the paper chamber and the ribbon chamber. The distance between the paper chamber and the rotation center of the take-up shaft is larger than the radius of a ribbon take-up portion of the take-up shaft and is smaller than the radius of a fully taken up roll of the ink ribbon.

18 Claims, 6 Drawing Sheets

RECORDING APPARATUS

BACKGROUND OF THE INVENTION

1. Field of the Invention

The present invention relates to a recording apparatus that transfers ink from an ink ribbon onto paper with a recording head on the basis of image information.

2. Description of the Related Art

A recording apparatus that forms an image (including letters and symbols) on a recording medium with a recording head on the basis of image information is used as a printer, a photocopier, a facsimile, or a scanner, or in a multifunction device or a system. As an example of such a recording apparatus, a thermal transfer recording apparatus that heats and transfers ink applied to an ink ribbon onto paper (a recording medium) with a recording head (thermal head) and thereby forms an image, may be used. In this thermal transfer recording apparatus, unlike other binary recording technologies, such as an ink jet recording apparatus, a pixel can have a wide range of gradation. Therefore, in step with the recent advancement of digital cameras, a thermal transfer recording apparatus has received much attention, particularly as a printer for a natural image.

In addition, there is known a system such that a printer is directly connected to an image pickup device, such as a digital camera. The printer can perform printing out without using a device that processes image information (such as a computer). Such a system makes it possible to print out the image information from a digital camera or a digital camcorder easily and photographically. Therefore, a thermal transfer recording apparatus has increasingly received much attention. Consumers want to carry a printer together with a digital camera, and compactness is an important selling point of a printer (recording apparatus).

As a method to reduce the size of a thermal transfer recording apparatus, a paper cassette containing paper and a ribbon cassette containing an ink ribbon are loaded adjacent one another in the apparatus body, and the wasted space is thereby reduced. Japanese Patent Laid-Open No. 2000-108442 discloses a printer in which a cassette for recording paper and a cassette for an ink ribbon are loaded so that they abut each other. FIGS. 9 to 11 show a common thermal transfer recording apparatus in which a paper cassette and a ribbon cassette are loaded so that they abut each other. FIG. 9 is a vertical sectional view showing a conventional recording apparatus with paper and an ink ribbon unused. FIG. 10 is a vertical sectional view showing the recording apparatus of FIG. 9 in recording operation. FIG. 11 is a vertical sectional view showing the recording apparatus of FIG. 9 with the paper in the paper cassette and the ink ribbon in the ribbon cassette used up.

In FIGS. 9 to 11, the recording media loaded in the paper cassette 102 are cut sheets 101. One end of an ink ribbon 103 is fixed to a supply shaft 104 and the other end is fixed to a take-up shaft 105. The ink ribbon 103 is wound on the supply shaft 104 and/or the take-up shaft 105. The ribbon roll 103*a* on the supply shaft 104 is housed in a supply side ribbon chamber 106*a*, and the ribbon roll 103*b* on the take-up shaft 105 is housed in a take-up side ribbon chamber 106*b*. The supply side ribbon chamber 106*a* and the take-up side ribbon chamber 106*b* are joined by a joining member and constitute a ribbon cassette 106.

When recording is performed, a paper feed mechanism (not shown) separates a sheet P from the sheets 101 in the paper cassette 102 and conveys it to the space between the thermal head 108 and a platen roller 109 along a conveyance path (not shown). The sheet P is further conveyed so as to be nipped between a conveyance roller pair 107. The sheet P and the ink ribbon 103 are pressed against each other between the thermal head 108 and the platen roller 109. In synchronization with the conveyance of the sheet P and the ink ribbon 103, the thermal head 108 is driven on the basis of image information, ink is transferred onto the sheet P, and an image is thereby formed. In the case of color recording, the sheet P is reciprocated so that color inks applied to the ink ribbon 103 are transferred onto the sheet P one over another, and a color image is thereby formed. After the recording is completed, the sheet P is discharged from the apparatus body.

In FIG. 9, both the sheets 101 and the ink ribbon 103 are unused, the paper cassette 102 is almost filled with the sheets 101, and almost all of the ink ribbon 103 is wound on the supply shaft 104. By repeatedly performing the recording operation shown in FIG. 10, the sheets 101 and the ink ribbon 103 are used up as shown in FIG. 11. In FIG. 11, the paper cassette 102 is empty, and all of the ink ribbon 103 is wound on the take-up shaft 105.

However, in the above conventional recording apparatus, with the consumption of the sheets 101, the empty space in the paper cassette 102 increases. This space is dead/wasted space. On the other hand, as for the ribbon cassette 106, there always is a space in each of the supply side ribbon chamber 106*a* and the take-up side ribbon chamber 106*b*, between the ribbon roll and the inner face of the ribbon cassette 106 from the start to the end of use of the ink ribbon 103. These spaces in the ribbon cassette 106 are also dead/wasted spaces. In conventional recording apparatus, such dead spaces cannot be eliminated nor reduced. Therefore, the space efficiency cannot be improved. This is an obstacle to reducing the size of the apparatus body.

SUMMARY OF THE INVENTION

The present invention provides a compact recording apparatus including a paper chamber capable of containing paper and a ribbon chamber containing an ink ribbon in a manner such that the ink ribbon on a supply shaft can be taken up onto a take-up shaft, by utilizing the dead spaces in the paper chamber and the ribbon chamber.

In an aspect of the present invention, a recording apparatus includes a paper chamber, a ribbon chamber, and a recording head. The paper chamber is capable of containing paper. The ribbon chamber is configured to contain an ink ribbon in a manner such that the ink ribbon on a supply shaft can be taken up onto a take-up shaft. The recording head is driven on the basis of an image signal and is configured to transfer ink from the ink ribbon onto the paper. The distance between the paper chamber and the rotation center of the take-up shaft is larger than the radius of a ribbon take-up portion of the take-up shaft and is smaller than the radius of a fully taken up roll of the ink ribbon.

Further features of the present invention will become apparent from the following description of exemplary embodiments (with reference to the attached drawings).

DESCRIPTION OF THE EMBODIMENTS

Figure 1:
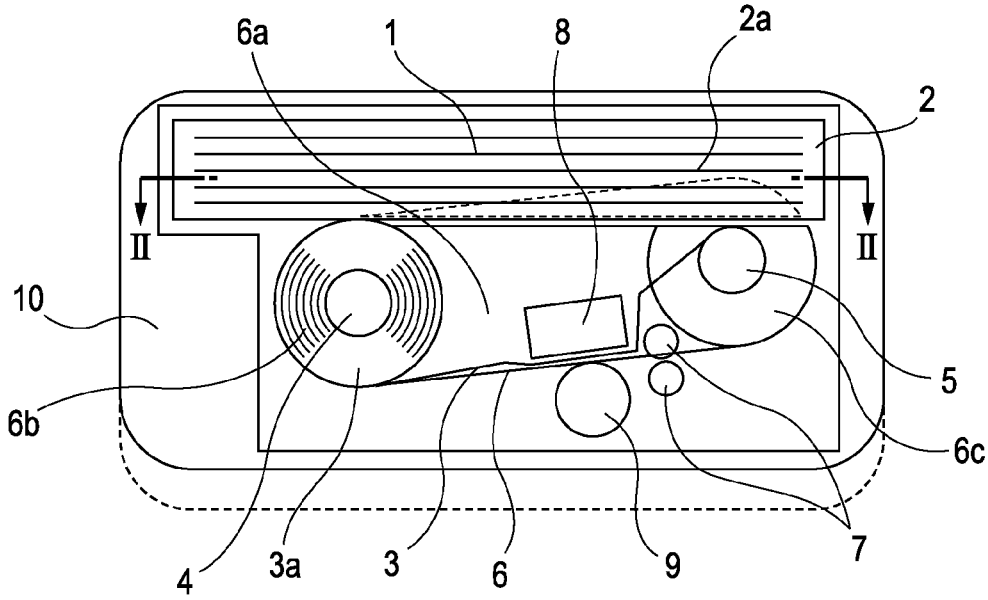
FIG. 1 is a vertical sectional view showing a recording apparatus according to a first embodiment of the present invention with paper and an ink ribbon unused.

The embodiments of the present invention will now be described with reference to the drawings. In every figure, the same reference numerals designate the same or corresponding components. FIG. 1 is a vertical sectional view showing a recording apparatus according to a first embodiment of the present invention with paper and an ink ribbon unused. In FIG. 1, a paper cassette 2 containing a stack of sheets 1 and a ribbon cassette 6 containing an ink ribbon 3 are detachably attached to an apparatus body 10.

In the ribbon cassette 6, a supply shaft 4 and a take-up shaft 5 are rotatably supported. The ink ribbon 3 is initially wound on the supply shaft 4 and is taken up onto the take-up shaft 5. When loaded with the paper cassette 2 and the ribbon cassette 6, the recording apparatus can perform recording. The paper cassette 2 has a paper chamber 2*a* formed therein. The paper chamber 2*a* contains a stack of sheets. The ribbon cassette 6 has a ribbon chamber 6*a* formed therein. The ribbon chamber 6*a* includes a supply side ribbon chamber 6*b* and a take-up side ribbon chamber 6*c*. The supply side ribbon chamber 6*b* contains a supply side ribbon roll 3*a*. The take-up side ribbon chamber 6*c* contains a take-up side ribbon roll 3*b*.

In FIG. 1, the recording paper loaded in the paper cassette 2 is a stack of cut sheets 1. One end of the ink ribbon 3 is fixed to the supply shaft 4 and the other end to the take-up shaft 5. The ink ribbon 3 is wound on the supply shaft 104 and/or the take-up shaft 105. The ribbon roll 3*a* on the supply shaft 4 and the ribbon roll 3*b* on the take-up shaft 5 are housed in the supply side ribbon chamber 6*b* and the take-up side ribbon chamber 6*c*, respectively. The ribbon chambers 6*b* and 6*c* are joined with a joining member, thereby forming the ribbon chamber 6*a* of the ribbon cassette 6.

Figure 2:
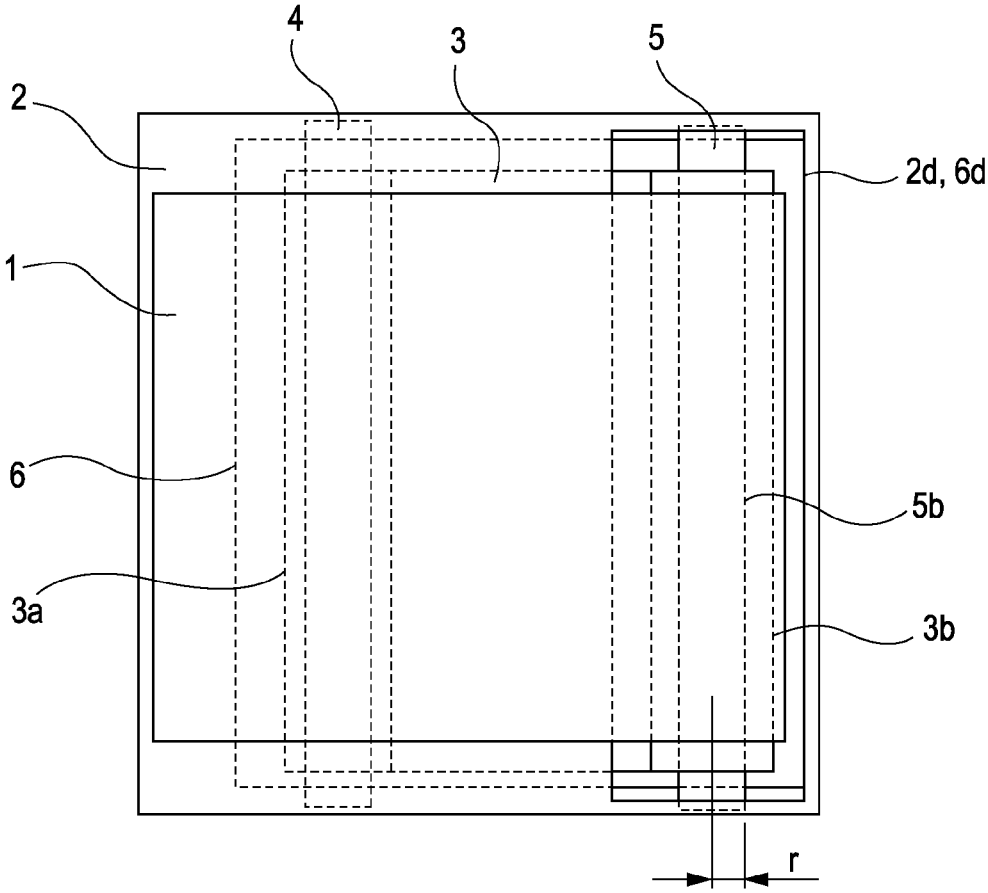
FIG. 2 is a sectional plan view showing the paper cassette and the ribbon cassette in FIG. 1 with the paper and the ink ribbon being used, taken along line II-II of FIG. 1.
Figure 3:
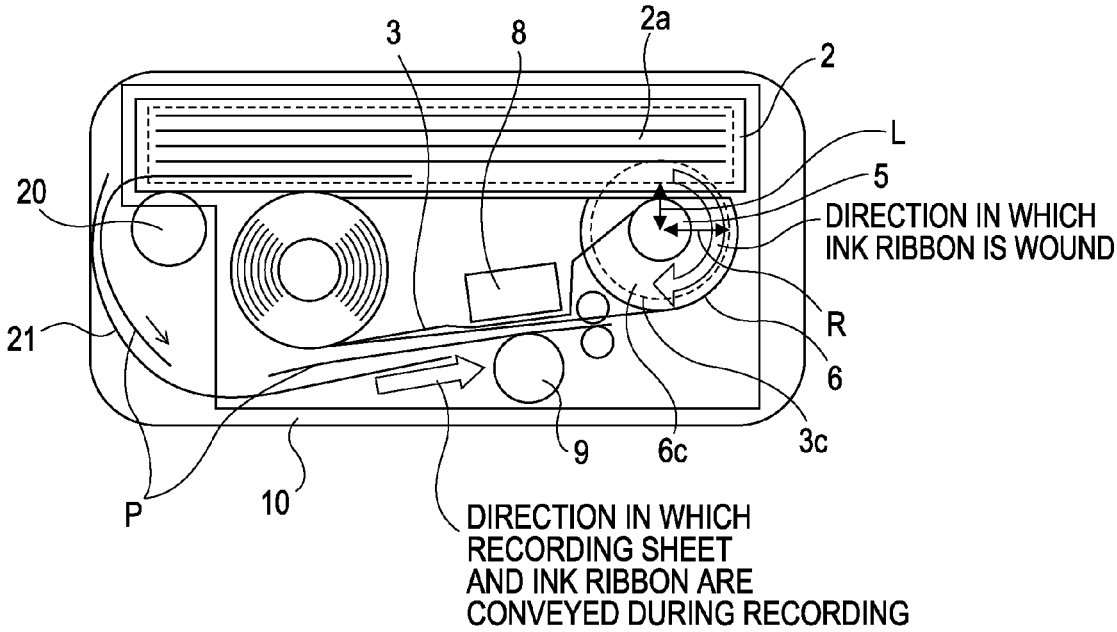
FIG. 3 is a vertical sectional view showing the recording apparatus of FIG. 1 in recording operation.
Figure 4:
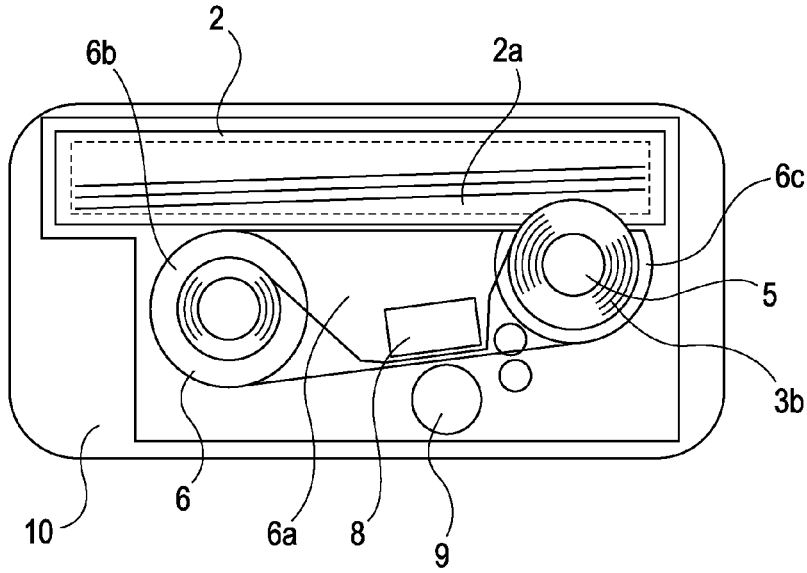
FIG. 4 is a vertical sectional view showing the recording apparatus of FIG. 1 with more than half of the paper and the ink ribbon used.

FIG. 2 is a sectional plan view showing the paper cassette and the ribbon cassette in FIG. 1 with the paper and the ink ribbon being used, taken along line II-II of FIG. 1. FIG. 3 is a vertical sectional view showing the recording apparatus of FIG. 1 in recording operation. FIG. 4 is a vertical sectional view showing the recording apparatus of FIG. 1 with more than half of the paper and the ink ribbon used. When an image is recorded, as shown in FIG. 3, a sheet P is separated from the sheets in the paper cassette 2 by a paper feed roller 20, passes along a paper conveyance path including a conveyance guide 21, and reaches an image forming section between a recording head (thermal head) 8 and a platen roller 9. The ink ribbon 3, subject to a take-up tensile force from the take-up shaft 5, is placed on top of the sheet P nipped by a conveyance roller pair 7, and the ink ribbon 3 and the sheet P are conveyed together.

At this time, the sheet P and the ink ribbon 3 are pressed against each other by the thermal head 8 and the platen roller 9. By selectively driving a plurality of heating elements arranged on the thermal head 8, the ink applied to the ink ribbon 3 is transferred onto the sheet P, and an image is thereby recorded. In the case of color recording, the ink ribbon 3 has repeating sets of a plurality of color ink coatings, for example, yellow, magenta, and cyan ink coatings, each color ink coating having the same length. The sheet P is reciprocated as often as the number of ink colors through the image forming section. The color inks are transferred onto the sheet P one over another, and a color image is thereby formed. As described above, in the case of color recording, the ink ribbon 3 has repeating sets of a plurality of color ink coatings, each color ink coating having the same length. One of these sets is used per sheet. Therefore, normally, a predetermined number of sheets of the paper 1 are consumed in one-to-one correspondence with the same number of sets in the ink ribbon 3.

For the above-described recording apparatus, a pack containing a predetermined number of sheets and an ink ribbon having the same number of sets is distributed in the market and is provided for users. When recording (printing) is performed, a user opens the pack and loads the sheets and the ink ribbon into the recording apparatus. Both expendable materials are used up at the same time. When they are used up, the user opens a new pack and loads new ones. Therefore, unless a user opens different kinds of packs at the same time and mix up the content thereof, the remaining amount of the paper loaded in the recording apparatus always has a constant relation to the amount of taken up ink ribbon.

Next, the characteristic configuration and operation of the recording apparatus according to this embodiment will be described with reference to FIGS. 1 to 4. In this embodiment, when the paper cassette 2 and the ribbon cassette 6 are loaded in the apparatus body and therefore recording is possible, the take-up shaft 5 is disposed at a position such that the distance L between the paper chamber 2*a* and the rotation center of the take-up shaft 5 is larger than the radius r of the ribbon take-up portion 5*b* of the take-up shaft 5 and is smaller than the radius R of the fully taken up ribbon roll 3*c*. The radius r of the ribbon take-up portion 5*b* of the take-up shaft 5 means the radius of the portion 5*b* when the ink ribbon 3 is not yet taken up on the take-up shaft 5 at all. The radius R of the fully taken up ribbon roll 3*c* means the radius of the ribbon roll 3*c* on the take-up shaft 5 when the ink ribbon 3 is fully taken up onto the take-up shaft 5 from the supply shaft 4.

As shown in FIG. 2, openings 2*d* and 6*d* are formed in the lower surface (lower wall) of the paper cassette 2 and the upper surface (upper wall) of the ribbon cassette 6, respectively, in order to prevent the surfaces (walls) from interfering with the ribbon roll 3*b* being taken up on the take-up shaft 5. These openings 2*d* and 6*d* are formed at predetermined positions and have a size slightly larger than the ribbon roll 3*c* fully taken up on the take-up shaft 5 in order to prevent the surfaces (walls) from interfering with the ribbon roll 3*c*. Due to such a configuration, the taken-up ribbon roll 3*b* can enter the paper chamber 2*a*.

Therefore, part of the paper chamber 2*a* and part of the ribbon chamber 6*a* (take-up side ribbon chamber 6*c*) of the ribbon cassette 6 overlap with each other in the area shown by a dotted line in FIG. 1. As the ink ribbon 3 is taken up from the supply shaft 4 to the take-up shaft 5 due to the recording operation, the take-up side ribbon roll 3*b* enters this overlapped area. Therefore, the area that the paper cassette 2 and the ribbon cassette 6 occupy in the apparatus body 10 of the recording apparatus can be reduced by the overlapped area. That is to say, compared to the configuration shown in FIGS. 9 to 11, the configuration of this embodiment can reduce the volume of the apparatus body 10 by the overlapped area shown by a dotted line in FIG. 1, when the same amount of paper and ink ribbon are loaded.

Figure 9:
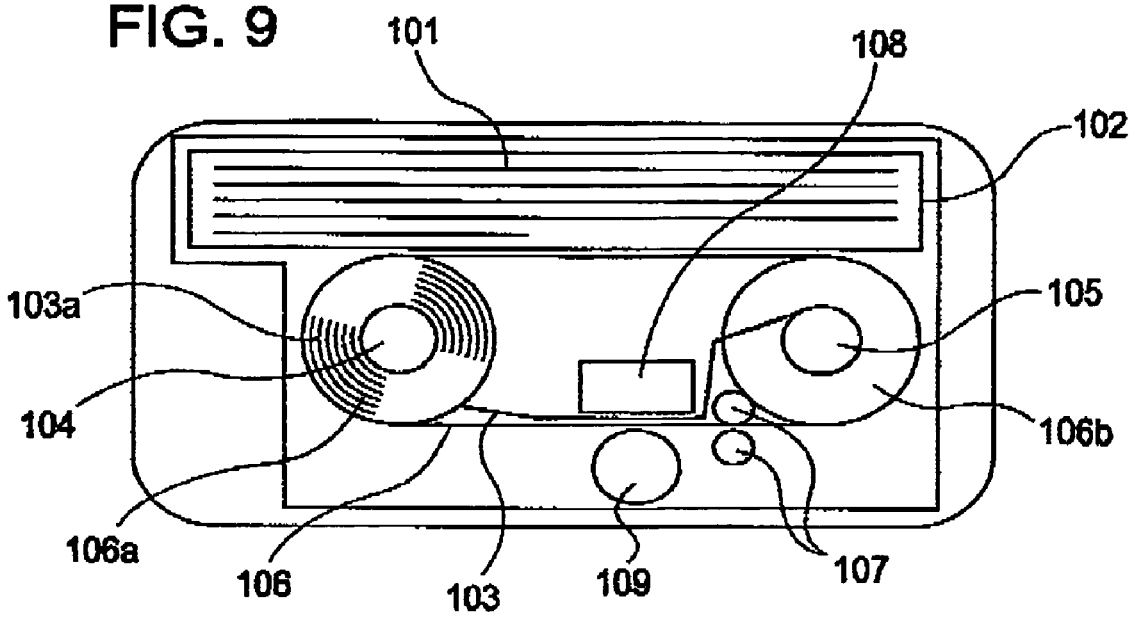
PRIOR ART FIG. 9
FIG. 9 is a vertical sectional view showing a conventional recording apparatus with paper and an ink ribbon unused.
Figure 10:
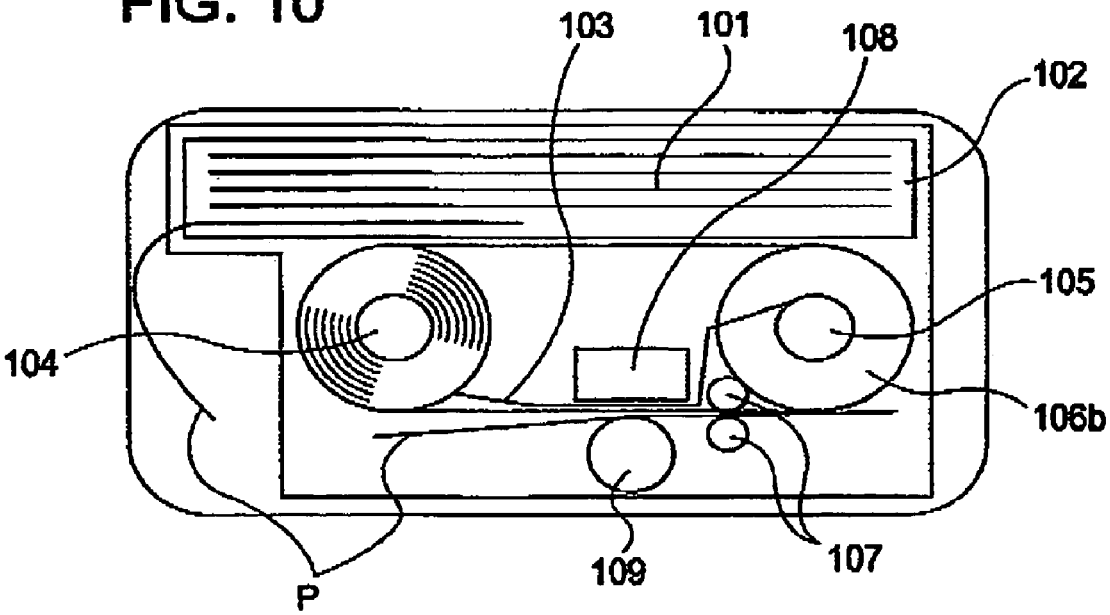
PRIOR ART FIG. 10
FIG. 10 is a vertical sectional view showing the recording apparatus of FIG. 9 in recording operation.
Figure 11:
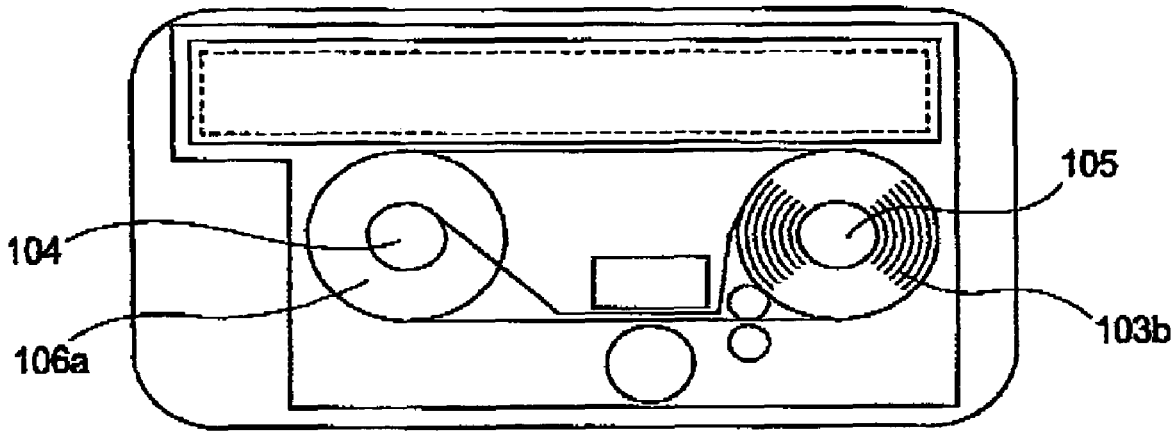
FIG. 11 PRIOR ART
FIG. 11 is a vertical sectional view showing the recording apparatus of FIG. 9 with the paper in the paper cassette and the ink ribbon in the ribbon cassette used up.

In addition, overlapping the paper chamber and the ribbon chamber as described above makes it possible to dispose the take-up side ribbon chamber 6*c* at a higher position compared to the conventional example of FIGS. 9 to 11. Therefore, the mechanisms of the image forming section, for example, the conveyance roller pair 7, the thermal head 8, and the platen roller 9 can also be disposed at a higher position. Disposing the components in such a manner makes it possible to reduce the size of the apparatus body 10 from the conventional size shown by a dashed line in FIG. 1 to the size shown by a solid line.

Next, a series of recording operations in this embodiment will be described with reference to FIG. 3. As described above, the paper feed mechanism including the paper feed roller 20 separates a sheet P from the sheets in the paper cassette 2 and feeds the sheet P to the image forming section opposite the thermal head 8 along the sheet conveyance path including the conveyance guide 21. When the fed sheet P is nipped and can be reciprocated by the conveyance roller pair 7, the sheet P and the ink ribbon 3 are pressed against each other between the thermal head 8 and the platen roller 9 so that the ink coated surface is in contact with the sheet P. Next, the sheet P is conveyed in the conveyance direction during recording shown by an arrow, and the take-up shaft 5 is rotated by a drive mechanism (not shown) in the direction shown by another arrow so that the ink ribbon 3 is conveyed in the same direction as the sheet P is conveyed. At this time, the take-up shaft 5 is rotated in the direction of the arrow so that the ink coated surface of the ink ribbon 3 is in contact with the sheet P and so that the ink ribbon 3 is wound with the ink coated surface facing inward. At the same time, by selectively driving the plurality of heating elements arranged on the thermal head 8 on the basis of image information, ink is thermally transferred onto the sheet P and thereby image recording is performed.

The ink ribbon 3 has repeating sets of a plurality of color ink coatings, for example, black, yellow, magenta, and cyan ink coatings, each color ink coating having the same length. The sheet P and the ink ribbon 3 are reciprocated the same number of times as the number of ink colors through the image forming section, and the recording operation (printing operation) is repeatedly performed. Thus, the color inks are transferred onto the sheet P one over another, and a color image is thereby formed. After the image formation, the sheet P is conveyed in the direction of the arrow and is then discharged from the apparatus body 10. Thus, a series of recording operations is completed.

FIG. 4 shows the configuration of a media cassette loaded in the apparatus body and having a paper chamber 2*a* and a ribbon chamber 6*a* in the condition of partial consumption of the paper and the ink ribbon. In FIG. 4, with the repeated recording operations, the outside diameter of the ribbon roll 3*b* taken up on the take-up shaft 5 increases, and the ribbon roll 3*b* enters the paper chamber 2*a* of the paper cassette 2 through the openings 6*d* and 2*d*. In this embodiment, the opening 6*d* is formed by removing the upper wall of the take-up side ribbon chamber 6*c* of the ribbon cassette 6. In the bottom surface of the paper cassette 2, the opening 2*d* is formed. The opening 2*d* has a size corresponding to the size (the length and the outside diameter) of the incoming ribbon roll 3*b*. Therefore, the ribbon roll 3*b* can enter the paper cassette 2 without being interfered with by the wall of the cassette.

The sheets P in the paper cassette 2 are consumed one at a time with the repetition of the recording operation. In the paper chamber 2*a*, the empty area enlarges by the sum of the thickness of the consumed sheets. In this embodiment, under any conditions, the height of the ribbon roll 3*b* from the bottom of the paper chamber 2*a* never exceeds the sum of the thickness of the consumed sheets. That is to say, three parameters: the thickness of a sheet P, the thickness of the ink ribbon 3, and the length of ink coating on the ink ribbon 3 used per sheet are appropriately determined. Therefore, even if the ribbon roll 3*b* comes into contact with the sheets P in the paper chamber 2*a*, the taking up of the ink ribbon 3 is not obstructed.

As shown in FIG. 4, when the ribbon roll 3*b* enters the paper chamber 2*a*, the ribbon roll 3*b* presses up the sheets 1. Therefore, after the ribbon roll 3*b* has entered the paper chamber 2*a*, the ribbon roll 3*b* is always in contact with the sheets. Since the ribbon roll 3*b* rotates during the recording operation, the ribbon roll 3*b* can rub the sheets 1. Even in that case, since the ink ribbon 3 is wound with the ink coated surface facing inward, ink does not adhere to the sheets 1. Since the recording apparatus according to this embodiment has the configuration described with reference to FIGS. 1 to 4, the area occupied by the paper chamber 2*a* and the ribbon chamber 6*a* (particularly the take-up side ribbon chamber 6*c*) can be reduced by the overlapped area. Therefore, the size of the apparatus body 10 can be reduced by this amount.

Figure 5:
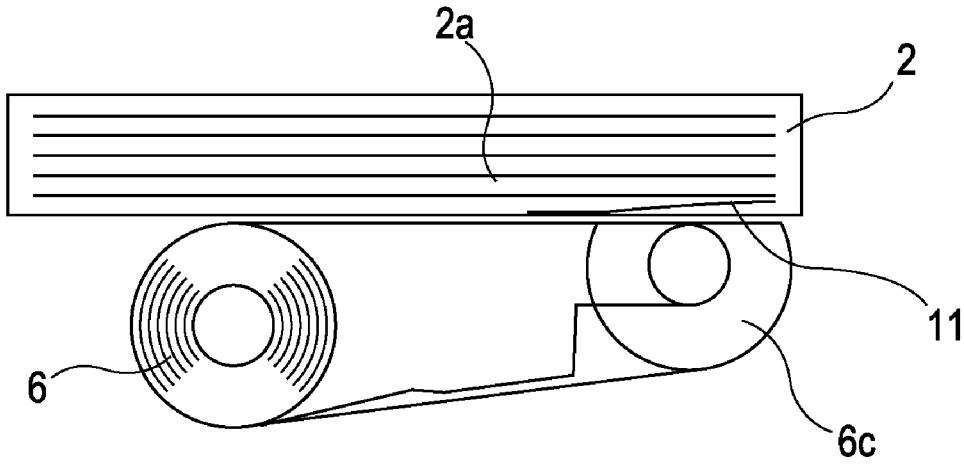
FIG. 5 is a vertical sectional view of a recording apparatus according to a second embodiment of the present invention with a paper cassette and a ribbon cassette unused.
Figure 6:
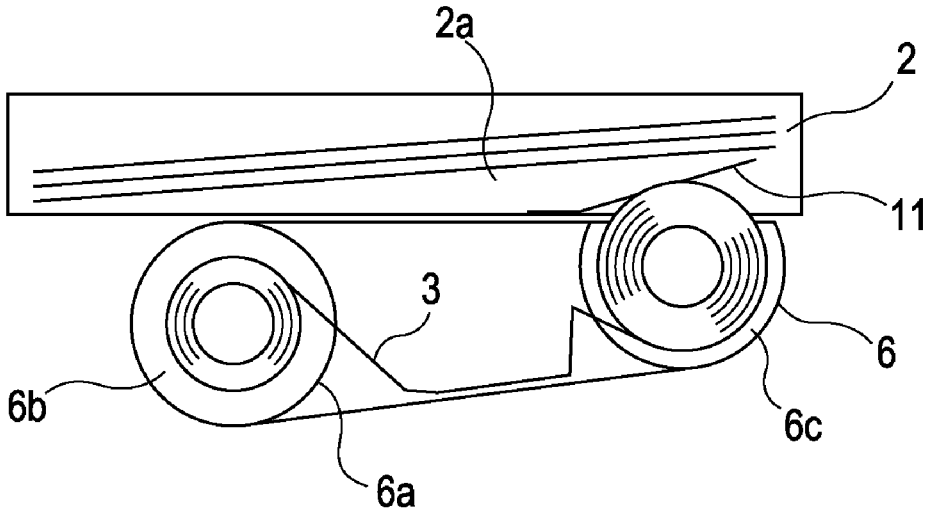
FIG. 6 is a vertical sectional view of the recording apparatus of FIG. 5 with more than half of paper and an ink ribbon used.

Next, the recording apparatus of the second embodiment will be described with reference to FIGS. 5 and 6. FIG. 5 is a vertical sectional view of a recording apparatus according to a second embodiment of the present invention with the paper cassette 2 and the ribbon cassette 6 unused. FIG. 6 is a vertical sectional view of the recording apparatus of FIG. 5 with more than half of the paper 1 and the ink ribbon 3 used. In FIGS. 5 and 6, as in the foregoing embodiment, the bottom surface of the paper cassette 2 is provided with an opening 2*d* so as not to interfere with the ribbon roll 3*b* entering the paper chamber 2*a*.

In this embodiment, the opening 2*d* is covered by a protective sheet 11. One end of the protective sheet 11 is fixed by adhesion on the paper outlet side of the opening 2*d* of the paper cassette 2. The protective sheet 11 is formed of a sheet material capable of elastic deformation (such as, for example, a resin or a plastics material) and can be displaced around the fixed portion as shown. With the entrance of the ribbon roll 3*b* into the paper cassette 2 due to the repeated recording operation (printing operation), the sheets 1 are pressed up by the ribbon roll 3*b* as shown in FIG. 6. The protective sheet 11 is always between the take-up side ribbon roll 3*b* and the underside of the sheets 1. This embodiment differs from the first embodiment in the above respects, but in other respects, this embodiment is substantially the same as the first embodiment. The same reference numerals will be used to designate the corresponding components.

In the first embodiment, the ink ribbon 3 is wound on the take-up shaft 5 with the ink coated surface facing inward. However, when the arrangement of the mechanisms in the apparatus body is restricted, it can be difficult to take up the ink ribbon 3 with the ink coated surface facing inward. In this embodiment, if the ink ribbon 3 is taken up with the ink coated surface facing outward, the protective sheet 11 can prevent ink from adhering to the sheets 1. In this case, after adhering to the protective sheet 11 from the ink ribbon 3, ink can re-adhere to the ribbon roll 3*b*. However, since the ink ribbon forming the ribbon roll 3*b* is a used ribbon, there is no problem.

In addition, in this embodiment, since the ribbon roll 3*b* is not directly in contact with the sheets 1, the lowermost sheet is not displaced due to friction with the rotating ribbon roll 3*b*. Therefore, when a paper feeding operation for the next recording is performed, a problem due to sheet displacement does not occur. As described above, the second embodiment provides the same advantageous effects as those in the first embodiment, and in addition, can eliminate problems due to direct contact between the sheets and the ink ribbon.

Although, in this embodiment, the protective sheet 11 is formed of a resin material, the protective sheet 11 may be formed of other materials, such as paper or aluminum foil. In addition, the shape of the protective sheet 11 and the method for attaching the protective sheet 11 are not limited. As long as the protective sheet 11 can prevent the contact between the sheets 1 and the ribbon roll 3*b*, the protective sheet 11 can be attached in a variety of ways. For example, instead of fixing one end of the protective sheet 11 to the paper cassette 2 as shown, a protective member movable between the sheets 1 and the ribbon roll 3*b* may be provided. Alternatively, a protective member may be attached to the ribbon cassette 6 or the apparatus body 10.

Figure 7:
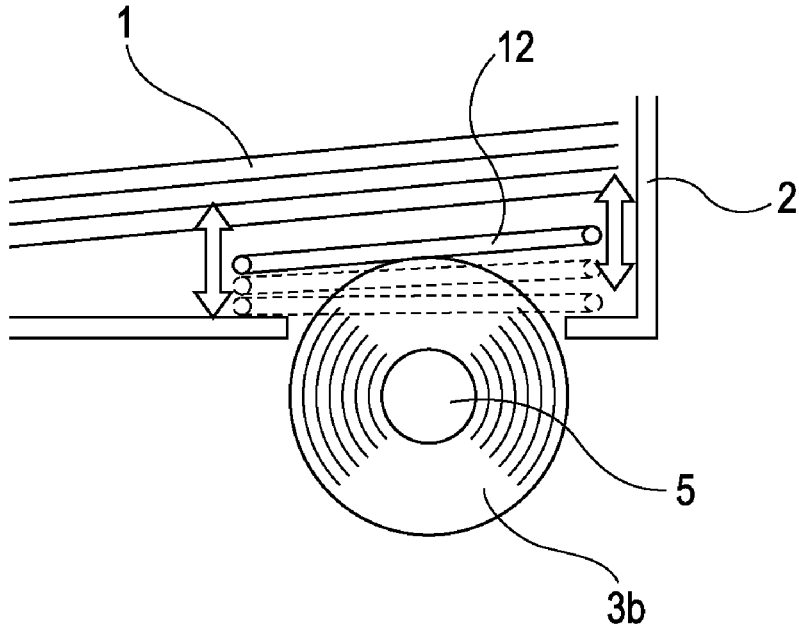
FIG. 7 is a fragmentary vertical sectional view showing a modification of the second embodiment using a plate-like protective member to prevent direct contact between the sheets and the ribbon roll.

FIG. 7 is a fragmentary vertical sectional view showing a modification of the second embodiment using a plate-like protective member 12 to prevent direct contact between the sheets 1 and the ribbon roll 3*b*. In this modification, the plate-like protective member 12 disposed between the sheets 1 and the ribbon roll 3*b* is supported at both ends so as to be movable in the vertical direction as shown by arrows and so as to be parallel to the boundary plane between the sheets and the ribbon roll. The modification of FIG. 7 differs from the configuration of FIGS. 5 and 6 in the above respects, but in other respects, this modification has substantially the same configuration. The same reference numerals will be used to designate the corresponding components. The modification provides the same advantageous effects as those in the configuration of FIGS. 5 and 6.

Figure 8:
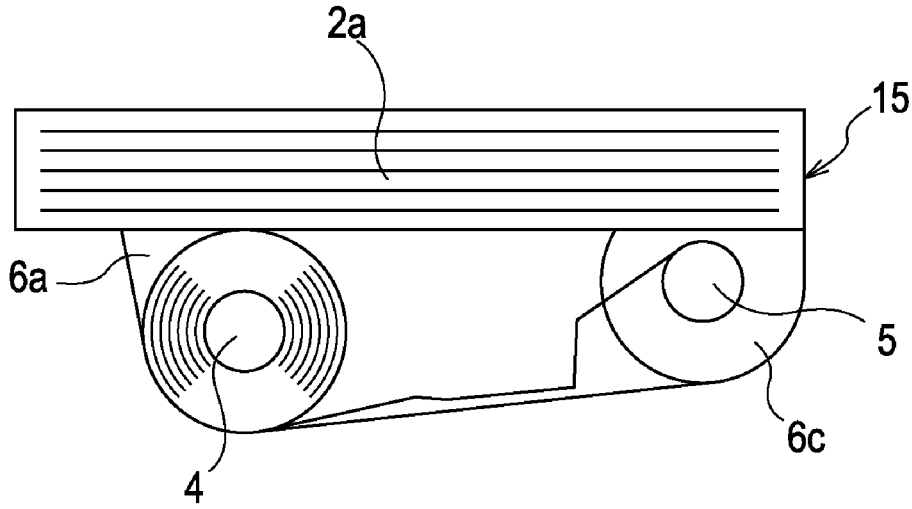
FIG. 8 is a vertical sectional view showing an unused media cassette for a recording apparatus according to a third embodiment of the present invention.

FIG. 8 is a vertical sectional view showing the configuration of the main part of a recording apparatus according to a third embodiment of the present invention. Unlike the foregoing embodiments separately having the paper cassette 2 and the ribbon cassette 6, this embodiment has an integral cassette (media cassette) 15. In FIG. 8, the media cassette 15 is not yet used at all. Although the first and second embodiments separately have the paper cassette 2 and the ribbon cassette 6, this embodiment has an integral cassette in which a paper chamber 2*a* and a ribbon chamber 6*a* are both formed. This embodiment differs from the foregoing embodiments in the above respects, but in other respects, this embodiment is substantially the same as the foregoing embodiments. The same reference numerals will be used to designate the corresponding components.

The third embodiment of FIG. 8 provides the same advantageous effects as those in the foregoing embodiments. In addition, the third embodiment provides the advantage that both paper and an ink ribbon can be loaded at the same time by just loading a single cassette 15. Therefore, the recording apparatus of the third embodiment is more user-friendly than those of the foregoing embodiments. In the first and second embodiments, the paper cassette 2 and the ribbon cassette 6 have the openings 2*d* and 6*d*, respectively. In contrast, the media cassette 15 of this embodiment can be closed. Therefore, dust and the like can be prevented from entering the paper chamber 2*a* and the ribbon chamber 6*a*, dust and the like can be prevented from adhering to the sheets 1 and the ink ribbon 3, and the deterioration of the recorded image (defective printing) due to dust and the like can be eliminated.

According to the above-described embodiments, a recording apparatus includes a paper chamber 2*a* containing paper 1 and a ribbon chamber 6*a* containing an ink ribbon 3 capable of being taken up. The paper 1 and the ink ribbon 3 are pressed against each other and conveyed. A thermal head 8 driven on the basis of image information transfers ink from the ink ribbon 3 onto the paper 1. The distance between the paper chamber and the rotation center of the take-up shaft 5 when recording can be performed is larger than the radius of the ribbon take-up portion of the take-up shaft 5 and is smaller than the radius of the fully taken up ribbon roll 3*c*. By overlapping the paper chamber and the ribbon chamber, the dead space can be reduced. By utilizing the dead spaces in the paper chamber and the ribbon chamber, a recording apparatus having a compact body can easily be provided. In the foregoing embodiments, the paper contained in the paper chamber is a stack of cut sheets. However, the present invention can be applied to a recording apparatus or a cassette having a paper chamber containing a roll of paper.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the priority of Japanese Application No. 2005-340166 filed Nov. 25, 2005, which is hereby incorporated by reference herein in its entirety.

What is claimed is:

1. A recording apparatus comprising:

a paper chamber capable of containing paper;

a ribbon chamber configured to contain an ink ribbon in a manner such that the ink ribbon on a supply shaft can be taken up onto a take-up shaft; and a recording head driven on the basis of an image signal and configured to transfer ink from the ink ribbon onto the paper, wherein the distance between the paper chamber and the rotation center of the take-up shaft is larger than the radius of a ribbon take-up portion of the take-up shaft and is smaller than the radius of a fully taken up roll of the ink ribbon.

2. The recording apparatus according to claim 1, wherein an opening is provided between the paper chamber and the take-up shaft in order to prevent the interference with a roll of the ink ribbon on the take-up shaft.

3. The recording apparatus according to claim 1, wherein the take-up shaft takes up the ink ribbon with the ink coated surface facing inward.

4. The recording apparatus according to claim 1, further comprising a protective member disposed between the paper chamber and the take-up shaft and configured to prevent direct contact between a roll of the ink ribbon on the take-up shaft and the paper in the paper chamber.

5. The recording apparatus according to claim 4, wherein the protective member is a sheet-like member capable of elastic deformation.

6. The recording apparatus according to claim 4, wherein the protective member is a movably supported plate-like member.

7. The recording apparatus according to claim 1, wherein the paper chamber is formed in a detachable paper cassette.

8. The recording apparatus according to claim 1, wherein the ribbon chamber is formed in a detachable ribbon cassette.

9. The recording apparatus according to claim 1, wherein the paper chamber and the ribbon chamber are formed in a detachable integral cassette.

10. The recording apparatus according to claim 1, wherein the paper contained in the paper chamber is a stack of cut sheets.

11. The recording apparatus according to claim 1, wherein the paper contained in the paper chamber is a roll of paper.

12. A recording apparatus comprising:

a paper chamber capable of containing paper;

a ribbon chamber configured to contain an ink ribbon in a manner such that the ink ribbon on a supply shaft can be taken up onto a take-up shaft; and a recording head driven on the basis of an image signal and configured to transfer ink from the ink ribbon onto the paper, wherein the take-up shaft is disposed so that part of a roll of the ink ribbon on the take-up shaft enters the paper chamber.

13. An integral cassette comprising:

a paper chamber capable of containing paper; and a ribbon chamber configured to contain an ink ribbon in a manner such that the ink ribbon on a supply shaft can be taken up onto a take-up shaft, wherein the take-up shaft is disposed so that part of a roll of the ink ribbon on the take-up shaft enters the paper chamber.

14. The cassette according to claim 13, wherein the paper chamber is provided with an opening that part of the ribbon roll on the take-up shaft enters.

15. The cassette according to claim 13, further comprising a protective member disposed between the paper chamber and the take-up shaft and configured to prevent direct contact between a roll of the ink ribbon on the take-up shaft and the paper in the paper chamber.

16. The cassette according to claim 13 capable of being loaded in a recording apparatus configured to transfer ink of the ink ribbon onto the paper taken out of the paper chamber and to thereby record an image on the paper.

17. A paper cassette capable of being loaded in a recording apparatus, the cassette comprising a paper chamber containing paper to be supplied to the recording apparatus, the recording apparatus comprising a recording head configured to transfer ink from an ink ribbon onto the paper and to thereby record an image on the paper, the cassette being provided with an opening so that part of a roll of the ink ribbon taken up on a take-up shaft enters the paper chamber when the cassette is loaded in the recording apparatus.

18. The cassette according to claim 17, further comprising a protective member configured to prevent direct contact between the ribbon roll on the take-up shaft and the paper in the paper chamber.

* * * * *